US005170211A

United States Patent [19]

Haupt et al.

[11] Patent Number: 5,170,211

[45] Date of Patent: Dec. 8, 1992

[54] AIR FILTRATION FOR XEROGRAPHIC CORONA DEVICES

[75] Inventors: George J. Haupt, Williamson; Bruce E. Thorp, Walworth, both of N.Y.

[73] Assignee: Xerox Corporation, Stamford, Conn.

[21] Appl. No.: 627,339

[22] Filed: Dec. 14, 1990

[51] Int. Cl.[5] ..... G03G 21/00

[52] U.S. Cl. ..... 355/215; 204/176; 355/221; 361/229

[58] Field of Search ..... 355/228, 229, 219, 221, 355/215, 219; 55/103, 124, 155, 482, 316, 524, 528; 361/229, 230, 225; 204/176

[56] References Cited

U.S. PATENT DOCUMENTS

| | | | |
|---|---|---|---|
| 3,744,217 | 7/1973 | Ebert | 55/118 |
| 3,844,741 | 10/1974 | Dimitrik | 55/102 |
| 3,936,184 | 2/1976 | Tanaka et al. | 355/215 |
| 3,956,458 | 5/1976 | Anderson | 423/210 |
| 3,988,131 | 10/1976 | Kanazawa et al. | 55/126 |
| 4,050,802 | 9/1977 | Tanaka et al. | 355/215 X |
| 4,178,092 | 12/1979 | Yamamoto et al. | 355/200 |
| 4,244,710 | 1/1981 | Burger | 55/6 |
| 4,388,274 | 6/1983 | Rourke et al. | 422/177 |
| 4,401,385 | 8/1983 | Katayama et al. . | |
| 4,466,813 | 8/1984 | Avritt et al. | 355/215 X |
| 4,540,268 | 9/1985 | Toyono et al. | 355/210 |
| 4,745,282 | 5/1988 | Tagawa et al. | 250/326 |
| 4,939,543 | 7/1990 | Barker | 355/215 |
| 5,021,831 | 6/1991 | Tonomoto | 355/215 |

*Primary Examiner*—A. T. Grimley
*Assistant Examiner*—T. A. Dang
*Attorney, Agent, or Firm*—Kenyon & Kenyon

[57] ABSTRACT

A copying apparatus which includes a filtering system defining an inlet and an outlet to the corotron cavity. Both the inlet and the outlet include filter material for filtering the air before it is delivered to the corotron cavity and filtering effluents generated during actuation of scorotron wires. The pathways to the inlet and the scorotron cavity are sealed to ensure little or no leakage of contaminated air which could be exposed to the scorotron wires. For this purpose two activated charcoal filters are doped with silver on a foam substrate, utilized both for the inlet and the outlet filters.

19 Claims, 1 Drawing Sheet 2
10
12
14
18
20
22
24
26
28
30
32
33
34
36
38
40
42
46
50
52
54
56
58
62
64
68
72
76

2
14
20
24
26
30
62
64
66
80
82

AIR FILTRATION FOR XEROGRAPHIC CORONA DEVICES

BACKGROUND AND DISCUSSION OF THE INVENTION

In xerographic corona devices scorotron wires are employed to generate the electrostatic charges on a photoreceptor belt for developing an image thereon. Such devices have had filter material arranged in an air flow path over the scorotron wires to filter out effluents generated during the charging step of the copying process. As the photoreceptor belt is moved past the corona device, the scorotron wires are activated to impart the electrostatic charge on the belt. Activation of the scorotron wires develop undesirable gases within the corona cavity, including ozone and nitric oxide(s) NO, $NO_2$ which should be filtered out (and or decomposed) before air is ejected into the surrounding atmosphere. In present corona devices, filters are arranged downstream of the corona cavity to filter out these unwanted effluents.

The problem with the system described above is the effect of gases and chemical compounds formed on the scorotron wires themselves, and ultimately the life of the corona device and photoreceptor belts. Premature failure of xerographic CRUs has been attributed to contamination deposit build up and growth on the corona devices. The discharged product such as ozone and nitric oxide(s) $NO_x$ (NO, $NO_2$ . . .) may accumulate in the process and react with the environment to adversely affect the latent image on the photoreceptor belt. For example, silicon oil vapor and ammonia, which are known to be the primary contributors to $SIO_2$ and ammonia nitrate dentrite and scale growth on the wires, can result in non-uniform charging, resulting in a flaming pattern on copies. This deposit on the wires and other effects of the unfiltered $O_3$ and $NO_x$ gases in this environment can adversely affect the life of the corotron unit and photoreceptor. Charged ion species that are formed in the corona will also build up concentration and adversely affect the latent electrostatic image resulting in a loss in contrast.

SUMMARY OF THE INVENTION

The invention described herein relates to a filtering system for reducing the adverse effects of various effluents on the corotron unit. As described and detailed in the preferred embodiment below, this is accomplished in part by providing a system for eliminating the negative effluents before air is exposed to the scorotron wires in the corona cavity. For this purpose a disposable dual-purpose air filter module is provided for corotrons to remove particulates and contaminating gas from the input air to the corona device and to remove harmful corona-generated effluents from the output. The module includes an inlet and an outlet for air to flow through the corotron cavity. The inlet is covered with a filter for filtering pressurized airflow into the corotron cavity. The outlet from this cavity is also provided with the filter, to filter out ozone, $NO_x$, $NH_3$ and other effluents generated during operation of the scorotron wires. The corotron cavity is sealed against the photoreceptor belt to minimize or eliminate contaminated air from entering the cavity other than through the filtered inlet. In addition, seals are provided on other portions of the copier to ensure that the pressurized air flow enters only through the filtered inlets.

The above has been a brief description of some deficiencies of the prior art and advantages of the invention. Other advantages will be apparent to those skilled in the art from the Detailed Discussion of the Preferred Embodiment which follows.

DETAILED DESCRIPTION OF THE PREFERRED EMBODIMENT

Figure 1:
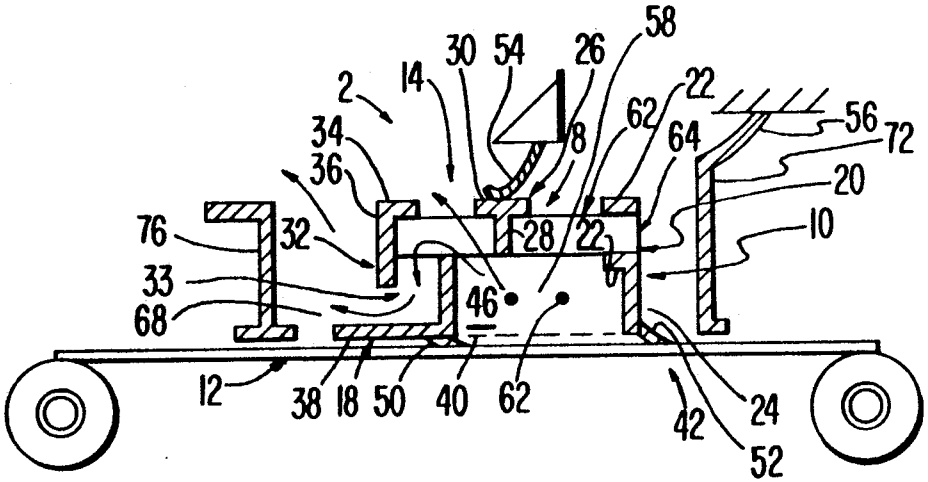
FIG. 1 is a cross-section of the module of the invention.
Figure 2:
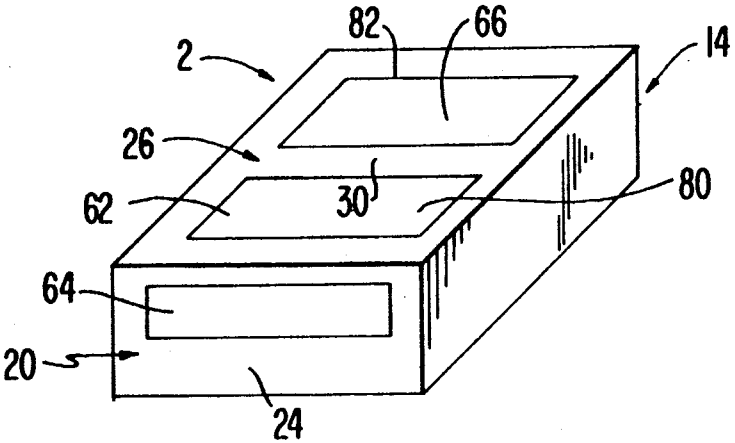
FIG. 2 is a perspective view of the module of the invention.

As can be seen in FIG. 1, the invention includes a module 2 having a charging unit 10 arranged adjacent photoreceptor belt 12 which rotates in a clockwise direction as shown. Charging unit 10 includes a frame 14 having upper frame assembly 16 and lower frame assembly 18. The upper frame assembly 16 includes a first end 20 having a first side portion 24 with a flange 22 extending at right angles thereto generally parallel to the path of movement of photoreceptor belt 12.

In charging unit 10 there is provided a second end 32 in opposed relationship to first end 20. Second end 32 includes crossbar 34 arranged in the same plane but substantially displaced from flange 22. Crossbar 34 is ultimately connected to second end wall 36 which is part of upper frame assembly 16. Flange 38 extends across second end wall 32 in a plane generally parallel to that defined by flanges 22 and lateral beam 30 but displaced from the latter to form a second end opening 33.

Between first end 20 and second end 32 is center support 26 for dividing the inlet from the outlet, as will be seen in the discussion which follows. This center support 26 includes center beam 28 generally parallel to first side 24 and second end wall 36. A lateral beam 30 extending across the entire width of the module has a width dimension less than the height of the center beam and extends equidistantly from either side thereof.

Lower frame assembly 18, in addition to second end wall 36 and second end wall flange 38, defines a lower baffle 44 that includes baffle sidewall 46.

The walls of the frame assemblies cooperate to define a corotron cavity 58 having inlet openings 80 and 64 and an upper outlet 66 and lower outlet 68. The corotron cavity is circumscribed by portions of the module defined by second end wall 36 and lower baffle 44, which in turn define an opening 42 having a grid 40 thereacross which exposes the scorotron wires 60 to photoreceptor belt 12. The scorotron wires are charged to 5 to 6 kilovolts with central grid 40 at 750–950 volts in operation.

The lower frame assembly 18 has bottom flap seals 50, 52 attached respectively to flange 38 and end wall 24 to engage the photoreceptor belt and avoid the introduction of undesirable gases or particulate contamination. Displaced from first end 20 is image baffle 72 to define a path therebetween for the image to be projected onto the photoreceptor belt 12 as shown. Upper flap seals 54 and 56 are in contact with the upper portions of center beam 30 and image baffle 72 as shown to insure internal elements of the copier machine define a closed path for the inlet to the corotron unit.

With this system a relatively closed path is provided for air under pressure into an upper inlet 62 and side inlet 64. Similarly, effluent gases are directed through upper outlet 66 and lower outlet 68. It should be noted that precharge opening wall 76 is displaced from the first end 20 of the charging unit 10 to define a recharged opening 74. This precharge opening is exposed to the photoreceptor belt 12 to permit discharge light to the belt before being subjected to the effect of scorotron wires 60. As this discharge step is well known to those skilled in the copier art, the details of its operation are not included herein.

In this particular environment, two activated charcoal filters 80, 82 doped with silver on a foam substrate are utilized for both the inlet and the outlet. Other filter substances could be employed, such as coated corrugated cardboard and activated carbon-coated polyester fiber. In the preferred embodiment the filters are conductive electrostatic elements charged to a potential about 3 kilovolts or more by the scorotron wires. The filter elements 80, 82 are formed from open cell polyurethane having about 30 cells per linear inch coated with about an equal amount by weight of conductive, activated carbon doped with 2% silver by weight of carbon. In the alternative, the filter material can be conventional HEPA (High Efficiency Particulate Arresting) filter material, a material known to those skilled in the art.

In operation, as the scorotron wires 60 are being activated, air under pressure is forced through the upper inlet 62 and side inlet 64 into the corotron cavity. Since this air is filtered through filter 80, substantially clean air without contaminants is forced over the corotron wires. During activation of the corotron wires there are contaminants and effluents generated which should be filtered before the air is permitted into the remaining part of the copier or the outside atmosphere. This air leaving the corotron cavity passes through filter 82 located in the upper outlet 66, lower outlet 68. Because of the interaction of the flaps 54 and 56 with surrounding elements in the copier compartment and flaps 50 and 52 with the belts, the air can only enter and leave the corotron cavity through the air from otherwise entering the corotron cavity and prematurely terminating the life of the module. The air flow through the corotron cavity is between about 1 and 2 cubic feet per minute.

With this configuration and air flow xerographic stability can be maintained. In addition, the filter provides chemical reaction sites that can remove silicone oil and ammonia vapor that otherwise would be growing on corona wires and grid as silicon dioxide and ammonia nitrate dendrites.

The above has been a detailed description of the preferred embodiment. The invention to which applicant is entitled is more fully defined in the claims hereafter. The specification should not be interpreted to unduly limit the scope of invention to which applicant is entitled as defined by the claims and their reasonable equivalents.

What is claimed is:

1. An apparatus for filtering air in an image forming machine comprising;

(a) an imaging element;

(b) a charger for imparting an electrostatic charge on said imaging element;

(c) a housing for said charger having an opening for exposing said charger to said imaging element;

(d) said housing having an inlet for permitting gas flow into said housing and an outlet for permitting gas flow out of said housing, with said charger being exposed to gas flow between said inlet and said outlet;

(e) a first filter located in said inlet for filtering contaminating gases contaminating said charger; and (f) a second filter located in said outlet for filtering effluents generated by said charger during operation, at least one of said filter and said second filter being a conductive electrostatic element capable of being charged to a voltage approaching that of the charger.

2. The apparatus according to claim 1 wherein said imaging element is a photoconductive surface.

3. The apparatus according to claim 2 wherein said first filter and said second filter include activated charcoal doped with silver on a foam substrate.

4. The apparatus according to claim 2 wherein said first filter and said second filter include coated corrugated cardboard.

5. The apparatus according to claim 2 wherein said first filter and said second filter include carbon coated with polyester fiber or conventional HEPA (High Efficiency Particulate Arresting) filter material.

6. An apparatus for filtering air in an image forming machine comprising:

(a) an imaging element, said imaging element being a photoconductive surface;

(b) a charger for imparting an electrostatic charge on said imaging element;

(c) a housing for said charger having an opening for exposing said charger to said imaging element;

(d) said housing including a first end and a second end, said second end being displaced from said first end, said housing having an upper portion between said first end and said second end, said housing defining inlets in said upper portion and said first end and outlets in said upper portion and said second end, said inlets and said outlets and said upper portion being separated by a center support, said inlets permitting gas flow into said housing and said outlets permitting gas flow out of said housing, with said charger being exposed to gas flow between said inlets and said outlets;

(e) a first filter located in said inlets for filtering contaminating gases contaminating said charger; and (f) a second filter located in said outlets for filtering effluents generated by said charger during operation, at least one of said first filter and said second filter being a conductive electrostatic element capable of being charged to a voltage approaching that of the charger.

7. The apparatus according to claim 6 wherein said housing includes a cavity and said charger being located within that cavity and including a corotron wire.

8. The apparatus according to claim 7 wherein said housing further includes a grid extending across the opening for exposing said charger to said photoconductive surface.

9. The apparatus according to claim 8 further comprising sealing means for sealing said opening against said photoconductive surface.

10. The apparatus according to claim 9 wherein said cavity is defined in part by a baffle, said baffle cooperating with said upper portion and said second end wall to define a path for effluents from said cavity to said outlets in said upper portion and in said second end wall.

11. The apparatus according to claim 10 further comprising an imaging path for allowing passage of images to said photoconductive surface, said imaging path defined by said first wall and an image baffle, said inlets in said housing and said imaging wall being fluidly sealed with surrounding structure to form a sealed path for air flow to the inlets of said housing.

12. The apparatus according to claim 11 further comprising a precharger wall spaced from said second end wall to define an area for discharging to a background level, the photoconductive surface prior to its exposure to said charger, said outlet of said housing being exposed to the area between said second end wall and said charger wall.

13. An apparatus for filtering air in an image forming machine comprising:

(a) a photoconductive surface;

(b) a charger for imparting an electrostatic charge on said photoconductive surface;

(c) a housing for said charger having an opening for exposing said charger to said photoconductive surface, said housing including a first end and a second end, said second end being displaced from said first end, said housing having an upper portion between said first end and said second end, said housing defining inlets in said upper portion and said first end and outlets in said upper portion and said second end, said inlets and said outlets and said upper portion being separated by a center support;

(d) said housing having an inlet for permitting gas flow into said housing and an outlet for permitting gas flow out of said housing, with said charger being exposed to gas flow between said inlet and said outlet;

(e) a first filter located in said inlet for filtering contaminating gases contaminating said charger; and (f) a second filter located in said outlet for filtering effluents generated by said charger during operation.

14. The apparatus according to claim 13 wherein said housing includes a cavity and said charger being located within that cavity and including a corotron wire.

15. The apparatus according to claim 14 wherein said housing further includes a grid extending across the opening for exposing said charger to said photoconductive surface.

16. The apparatus according to claim 15 further comprising sealing means for sealing said opening against said photoconductive surface.

17. The apparatus according to claim 16 wherein said cavity is defined in part by a baffle, said baffle cooperating with said upper portion and said second end wall to define a path for effluents from said cavity to said outlets in said upper portion and in said second end wall.

18. The apparatus according to claim 17 further comprising an imaging path for allowing passage of images to said photoconductive surface, said imaging path defined by said first wall and an image baffle, said inlets in said housing and said imaging wall being fluidly sealed with surrounding structure to form a sealed path for air flow to the inlets of said housing.

19. The apparatus according to claim 18 further comprising a precharger wall spaced from said second end wall to define an area for discharging to a background level, the photoconductive surface prior to its exposure to said charger, said outlet of said housing being exposed to the area between said second end wall and said charger wall.

* * * * *

UNITED STATES PATENT AND TRADEMARK OFFICE

CERTIFICATE OF CORRECTION

PATENT NO. : 5,170,211

DATED : 8 December 1992

INVENTOR(S) : George J. HAUPT et al.

It is certified that error appears in the above-identified patent and that said Letters Patent is hereby corrected as shown below:

| Column | Line | |
|---|---|---|
| 4 | 10 | Change "said filter" to --said first filter--. |

Signed and Sealed this

Second Day of November, 1993

Attest:

Bruce Lehman

BRUCE LEHMAN

Attesting Officer

Commissioner of Patents and Trademarks